US009657985B2

(12) United States Patent
Bhatt et al.

(10) Patent No.: US 9,657,985 B2
(45) Date of Patent: May 23, 2017

(54) CRISPER ASSEMBLY FOR REFRIGERATORS

(71) Applicant: Whirlpool Corporation, Benton Harbor, MI (US)

(72) Inventors: Nirbhay K. Bhatt, Pune, IN (US); Rahul S. Dudhe, Pune, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 41 days.

(21) Appl. No.: 14/641,534

(22) Filed: Mar. 9, 2015

(65) Prior Publication Data

US 2016/0265837 A1 Sep. 15, 2016

(51) Int. Cl.

| | |
|---|---|
| ***A47B 96/04*** | (2006.01) |
| ***F25D 25/02*** | (2006.01) |
| ***F25D 23/02*** | (2006.01) |

(52) U.S. Cl.

CPC ..... *F25D 25/025* (2013.01); *F25D 23/025* (2013.01)

(58) Field of Classification Search

CPC .. A47B 2088/0403; A47B 67/00; A47B 67/04
USPC ..... 312/286, 301, 309–311, 402, 404
See application file for complete search history.

(56) References Cited

U.S. PATENT DOCUMENTS

| | | | | |
|---|---|---|---|---|
| 3,970,010 | A * | 7/1976 | Cantley | A47B 67/04 109/47 |
| 4,436,352 | A * | 3/1984 | Okada | A47B 77/16 312/228 |
| 4,653,818 | A * | 3/1987 | DeBruyn | A47B 77/16 211/113 |
| 6,086,176 | A * | 7/2000 | Aoyama | A47B 67/04 312/286 |
| 6,220,682 | B1 * | 4/2001 | Vertullo | A47B 46/00 312/334.24 |
| 6,253,568 | B1 | 7/2001 | Peffley | |
| 6,935,712 | B2 * | 8/2005 | Reed | E05D 11/1078 312/204 |
| 8,109,581 | B1 * | 2/2012 | Lazenby | A47B 88/00 312/311 |
| 2011/0083464 | A1 | 4/2011 | Kettles | |
| 2012/0209763 | A1 * | 8/2012 | Zabbatino | G06Q 30/0645 705/39 |

FOREIGN PATENT DOCUMENTS

| | | | |
|---|---|---|---|
| CN | 103292542 | A | 9/2013 |
| DE | 102005021848 | A1 | 10/2006 |
| FR | 2831951 | A1 | 5/2002 |
| KR | 20110040578 | A | 4/2011 |

* cited by examiner

*Primary Examiner* — Matthew Ing
(74) *Attorney, Agent, or Firm* — Price Heneveld LLP

(57) ABSTRACT

A refrigerator has a refrigeration compartment and a freezer compartment. A crisper assembly is configured to be stowed in the refrigeration compartment, and is movable between retracted and extended positions. The crisper assembly includes a support structure and one or more bins that are configured to hold items for storage. The bin is movable relative to the support structure between a first position in which items within the bin are not accessible, and a second position in which items within the bin are accessible. The crisper assembly moves in a first direction relative to the refrigeration compartment, and the bin moves relative to the support structure in a second direction that is transverse to the first direction.

20 Claims, 7 Drawing Sheets

CRISPER ASSEMBLY FOR REFRIGERATORS

BACKGROUND OF THE INVENTION

The present invention generally relates to a crisper assembly disposed within a refrigerator, and more specifically, to a side loading crisper assembly that provides better access to the items disposed therein.

BRIEF SUMMARY OF THE INVENTION

According to one aspect of the present invention, a crisper assembly for a refrigerator is provided. The assembly includes a crisper structure defining a crisper cavity within the crisper structure. A guide is configured to movably attach the crisper structure to a refrigerator and movably support the crisper structure for movement in a first direction between a retracted position within a refrigerator compartment and an extended position. A bin is movably supported by the crisper structure for movement in a second direction between a first position wherein the bin is disposed in the crisper cavity and second position wherein at least a portion of the bin is disposed outside the crisper cavity.

According to another aspect of the present invention, a refrigerator is provided. The refrigerator includes an insulated cabinet defining a refrigerated compartment. A door is movably mounted to the insulated cabinet and provides access to the refrigerated compartment. A crisper assembly is disposed within the compartment. The crisper assembly is configured to maintain uniform humidity and is defined by a plurality of surfaces. The crisper assembly is movably supported by the insulated cabinet for generally horizontal movement from a stowed position within the refrigerated compartment to an extended position wherein a portion of the crisper assembly is disposed outside the refrigerated compartment. A bin is movably supported by the crisper assembly. The bin is moveble between a first position and a second position in a second direction.

According to yet another aspect of the present invention, a crisper for a refrigerator is provided. The crisper assembly includes a frame supporting a plurality of surfaces. The frame is movable in a first direction. A bin is configured to be substantially disposed within the frame and to hold refrigerated items therein. A portion of the bin is independently movable in a second direction between a first position and a second position.

These and other features, advantages, and objects of the present invention will be further understood and appreciated by those skilled in the art by reference to the following specification, claims, and appended drawings.

DETAILED DESCRIPTION

As required, detailed embodiments of the present invention are disclosed herein. However, it is to be understood that the disclosed embodiments are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

The following disclosure describes a crisper assembly for a refrigerator that advantageously moves between retracted and extended positions. The crisper may include a movable bin within the crisper assembly providing better access to items disposed therein.

Figure 1:
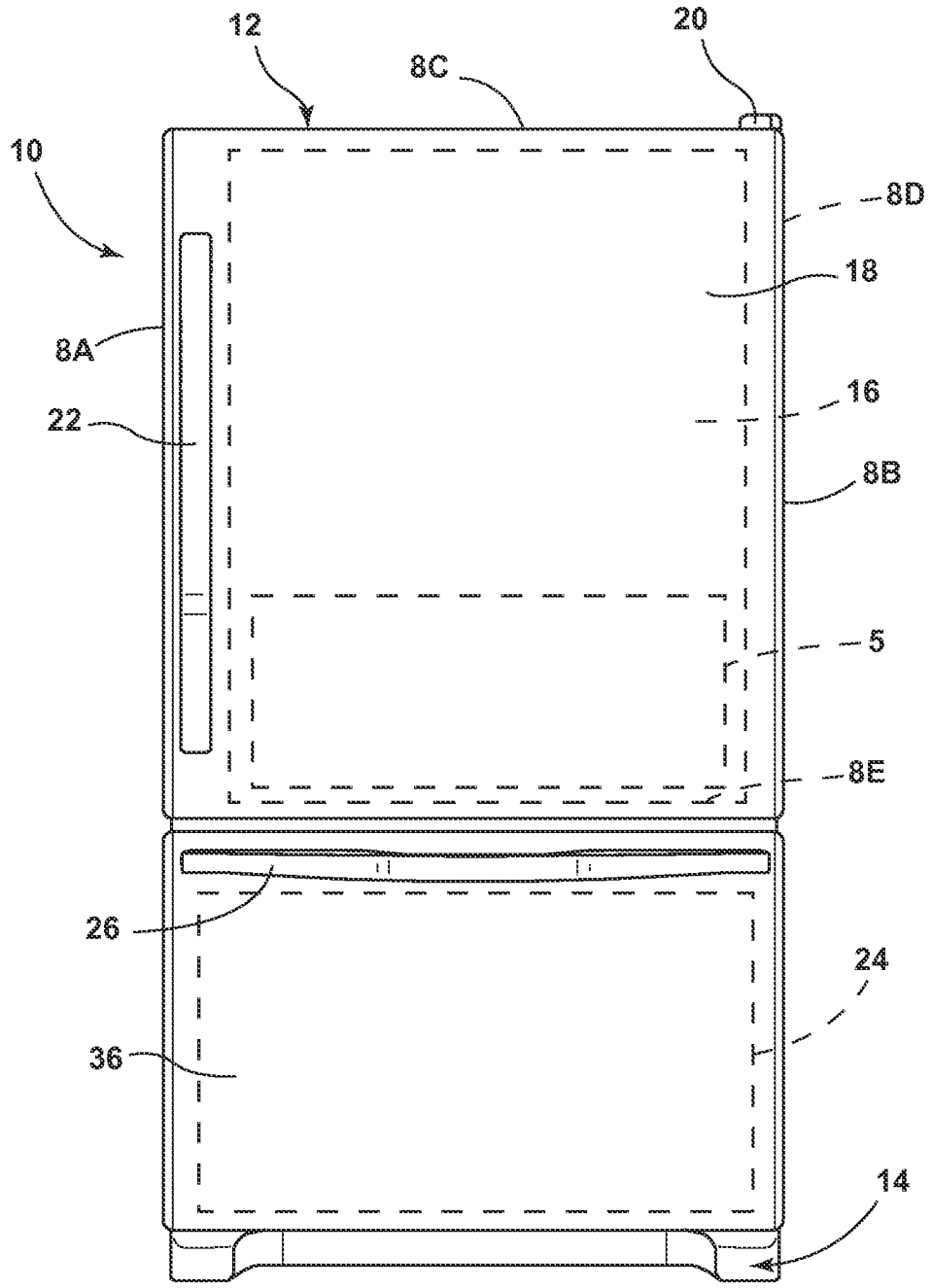
FIG. 1 is a front view elevational of a refrigerator having a bottom-mount freezer and a single refrigerator compartment door and a crisper assembly according to the present invention.

Referring to FIG. 1, a home appliance is shown as a domestic refrigerator appliance 10 (hereinafter refrigerator 10). The refrigerator 10 includes a cabinet 12 and a lower frame 14 that is configured to support the cabinet 12 on a floor surface or the like (not shown). The refrigerator cabinet 12 includes a plurality of insulated walls 8A-8E defining a refrigerated upper compartment 16 having a vertical front opening 32 that is selectively closed off by a door 18. Compartment 16 is generally defined by upright opposite side walls 8A and 8B, upper horizontal wall 8C, vertical rear wall 8D, and a horizontal lower divider wall 8E that separated refrigerated compartment 16 from freezer compartment 24. Front panel 36 may comprise an insulated door that is movably mounted to cabinet 12 by hinges (not shown) to provide access to freezer compartment 24. Alternatively, freezer compartment 24 may comprise a pull-out bin type unit having an upper opening that provides access to the compartment 24. Refrigerator 10 includes a refrigerated system 5 that is configured to cool refrigerated compartment 16 and freezer compartment 24. For example, refrigeration system 5 may comprise a conventional system including a compressor, condenser, expansion valve, and an evaporator. Alternatively, refrigeration system 5 may comprise a thermoelectric unit or other suitable system. In general, refrigeration system 5 includes one or more sensors in compartments 16 and/or 24, and a controller that actuates the system to maintain the compartments 16 and/or 24 at user-selected temperatures.

When door 18 is open (FIG. 3), a user may place and store food items such as milk, cheese, produce, etc. in compartment 16 through opening 32. The refrigerated compartment 16 is operable to maintain stored food items at a user-selected temperature that is typically well below room temperature but above freezing.

Door 18 is movably connected to the refrigerator cabinet 12 via a hinge assembly 20. A handle 22 is located on a front panel of the door 18, and the user may grasp the handle 22 to pull the corresponding door 18 open.

As shown in FIG. 1, the refrigerator cabinet 12 also defines a bottom-mount freezer compartment 24, which is independently operable to maintain food items stored therein at a user-selected temperature. Freezer compartment 24 is generally defined by upright sidewalls 8A and 8B, horizontal lower sidewall 8F, rear sidewall 8D, and divider 8E. Sidewalls 8A-8F may be insulated. The freezer compartment 24 includes a handle 26 that permits user access to the freezer compartment 24 such that food items may be placed in and retrieved from shelves and drawers positioned therein. When the freezer compartment 26 is in the closed position shown in FIG. 1, user access to the freezer compartment 24 is prevented. It will be appreciated that the present invention is not limited to the specific configuration shown in the drawings. For example, the freezer compartment may be positioned above or side-by-side with the refrigerated compartment 16 according to other aspects. It will be further appreciated that a refrigerator 10 according to other aspects of the present invention may not have a freezer compartment 24.

Figure 2:
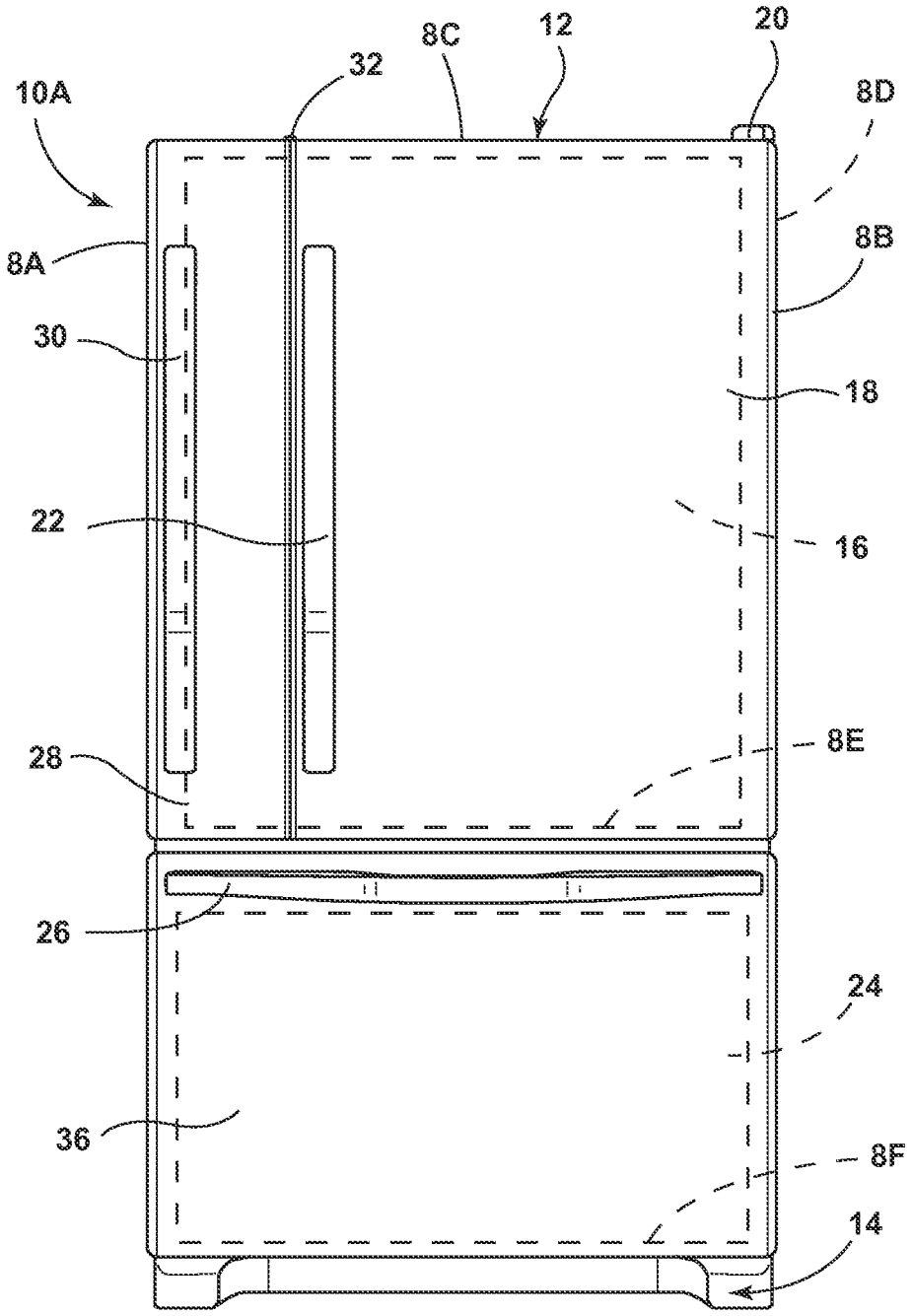
FIG. 2 is a front elevational view of a refrigerator having a bottom-mount freezer and two independent refrigerator compartment doors and a crisper assembly according to another aspect of the present invention.

Referring to FIG. 2, a refrigerator 10A according to another aspect of the present invention includes a first door 18 and a second door 28. Each door 18, 28 may be opened independently to provide access to the refrigerator compartment 16 through front opening 32. Additional components may be disposed within either of the access doors 18, 28, such as a crisper assembly 34, which will be described in more detail below. Doors 18 and 28 may include hinge assemblies 20 and 32 and respectfully may independently open outwardly. Alternatively, either or both doors 18, 28 may be coupled to a storage compartment disposed within the refrigerator compartment 16 that slides outwardly through use of an externally located handle 22, 30 to access items stored within the refrigerator compartment 16. In such configurations, either or both doors 18, 28 may include a slide assembly instead of or in combination with a hinge assembly 20 for allowing access to the refrigerator compartment 16. Alternately the compartment 28 can be directly attached to the vertical crisper, this can be slid out directly. In this design the door 28 would not be attached to the hinge.

Figure 3:
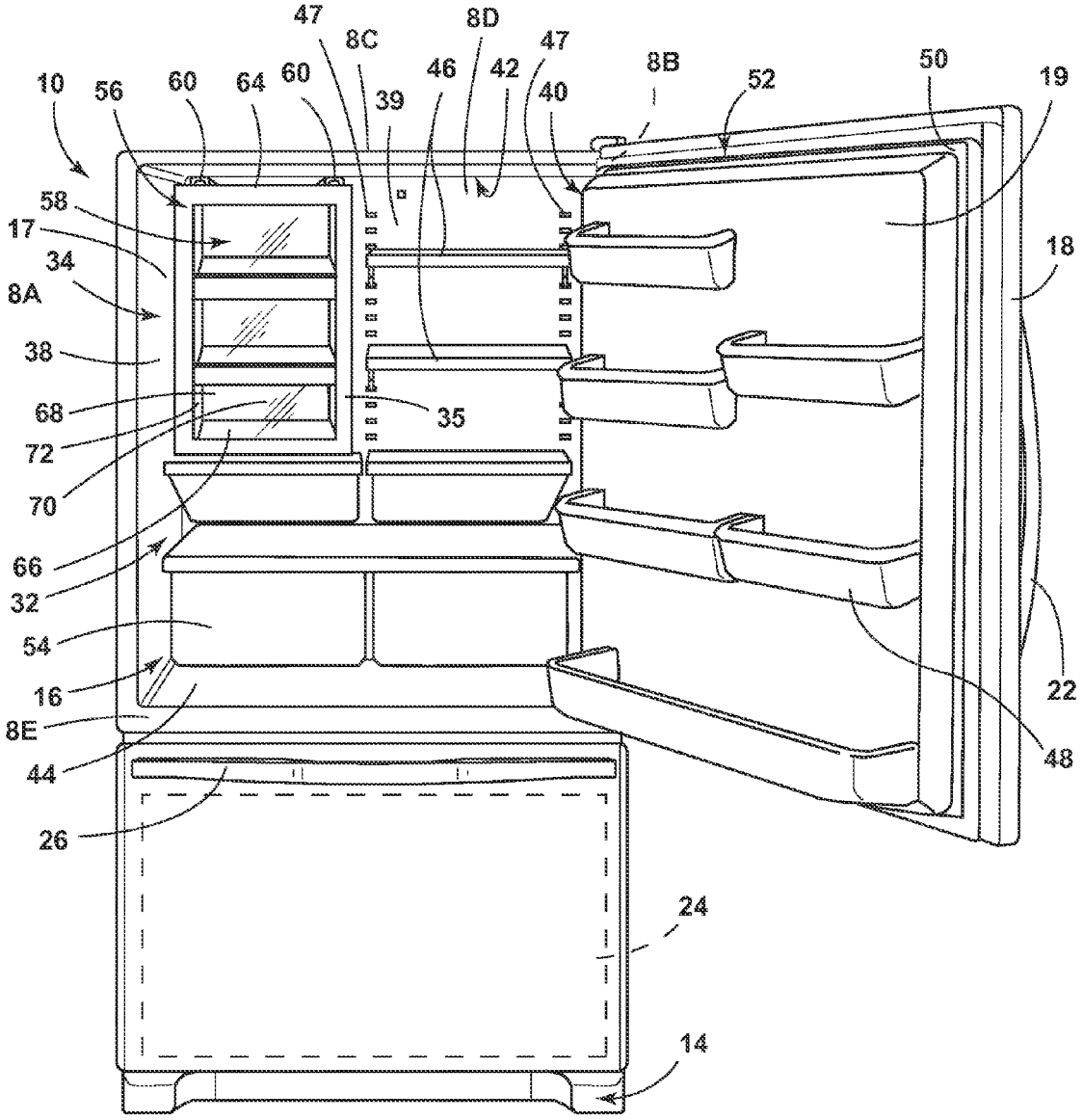
FIG. 3 is a perspective view of the refrigerator of FIG. 1 wherein the refrigerator compartment door is open to illustrate a crisper assembly mounted in an upper portion of the refrigeration compartment.

Referring to FIG. 3, sidewalls 8A-8D include inner surfaces 38, 40, 42, and 44, respectively, and rear sidewall 8D includes a forwardly-facing upright rear surface 39. Shelves 46 are adjustably supported on slots or openings 47 in rear surface 39, and shelves 48 are supported on an inner side 19 of door 18. The refrigerator compartment 16 has an open front side that defines a front access opening 32, which provides a user access to the shelves 46, 48 of the refrigerator compartment 16 when the door 18 is open. When the door 18 is closed, an elongated resilient seal 50 on a back panel 52 of the door 18 seals the front access opening 32, in a known manner, thereby preventing the user from accessing the shelves 46, 48, and preventing chilled air from escaping through the front access opening 32.

As shown in FIG. 3, the refrigerator 10 has a storage drawer 54 that is positioned above the surface 44 of sidewall 8E of the refrigerator compartment 16. A crisper assembly 34 is positioned in an upper portion 17 of the refrigerated compartment 16 proximate to the eye level of a user. The crisper assembly 34 includes a frame 56 secured to surface 42 of upper horizontal wall 8C of cabinet 12. Frame 56 of crisper assembly 34 defines a cavity or storage chamber 58.

As discussed in more detail below, frame 56 of crisper assembly 34 is movably mounted to cabinet 12 by a linear guide such as slider assembly 60 that permits a user to manually move the crisper assembly 34 horizontally outward from a retracted position to an extended position and visa-versa. In the retracted position, the crisper assembly is disposed within the refrigerator compartment 16. In an extended position, the crisper assembly 34 may be partially disposed outside of the refrigerator compartment 16. As discussed in more detail below, when crisper assembly 34 is in extended position, a bin 62 (see also FIG. 4) may be operable between first and second positions to selectively permit user access to the crisper storage chambers 58 and food items disposed therein. Linear slider assembly may include a stop (not shown) that limits outward movement of the crisper assembly 34 to prevent inadvertent complete withdrawal of the crisper assembly 34 from the refrigeration compartment 16. For example, the stop may comprise a protrusion extending from an underside of the crisper assembly 34 at a location such that the protrusion engages against a ridge or shoulder (not shown) formed in the surface 42 of the refrigeration compartment 16 at a fully extended position of the crisper assembly 34.

The crisper assembly 34 includes outer panels 64, 66, 68, 70, and 72 that are supported by frame 56. Outer panels 64, 66, 68, 70, and 72 define a crisper compartment that is maintained at a substantially uniform humidity and temperature. In the illustrated embodiment, the crisper assembly 34 contains a top panel 64, bottom panel 66, rear panel 68, front panel 70, and side panel 72. Each panel 64, 66, 68, 70, 72 is attached to the crisper assembly frame 56. In some embodiments, a resilient seal (not shown) may be disposed between the crisper assembly panels 64, 66, 68, 70, 72 and the crisper assembly frame 56. A second side 35 of the crisper assembly 34 does not include a panel, and is therefore open to the refrigeration compartment 16. However, the first and second sides of the crisper assembly 34 may both be open to the refrigeration compartment 16.

Still referring to FIG. 3, the panels 64, 66, 68, 70, and 72 of the crisper assembly 34 may be made of a polymer material. Exemplary materials include polyethylene terephthalate, polyethylene, polyvinyl chloride, polycarbonate, polypropylene, acrylonitrile butadiene styrene, or other suitable materials. However, it is contemplated that the panels 64, 66, 68, 70, and 72 may be of any practicable material. In the illustrated embodiment, the top 64, bottom 66, rear 68, and one side 72 panel are all made of an opaque polymer material. The front panel 70 comprises a transparent polymer material whereby the items stored within the crisper assembly are readily visible to a user looking into the refrigeration compartment 16.

As discussed above, the crisper assembly 34 of FIG. 3 may be attached to the top wall 42 of the cabinet 12 by slider assembly 60. However, the present invention is not limited to the arrangement of FIG. 3. The slider assembly 60 may be attached to any side of the crisper assembly frame 56 and/or to any surface of the crisper assembly 34. Additionally, the slider assembly 60 may also be removably attached to any suitable surface of the cabinet 12.

The slider assembly 60 of the crisper assembly 34 may comprise rack and pinion sliders (not shown) to permit the crisper assembly to easily slide in and out of the refrigerator 10. Although slider assembly 60 preferably comprises a linear slide, other known guides or supports (linear or non-linear) that permit the crisper assembly 34 to move in and out of the cabinet 12 may also be used. Preferably, the crisper assembly 34 is provided with a mechanism (not shown) for closing/retaining the crisper assembly 34 in a tight sealed configuration once the crisper assembly 34 is brought in close proximity to the closed position. The closing mechanism may comprise a known mechanism of the type utilized for closing drawers.

Figure 4:
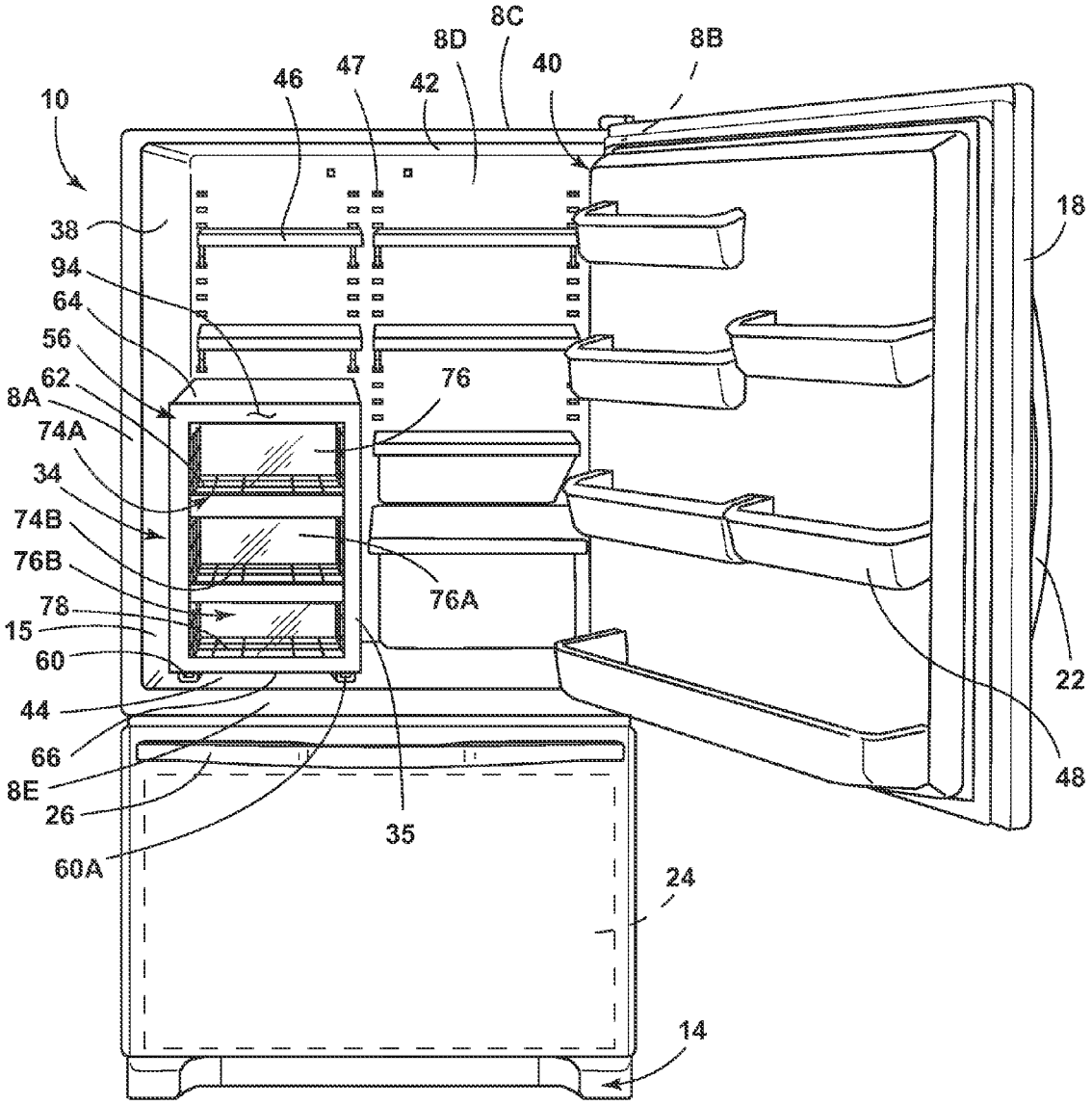
FIG. 4 is a perspective view of a refrigerator according to another aspect of the present invention including similar to FIG. 3 with the refrigerator compartment a crisper assembly that is mounted in a lower portion of the refrigeration compartment.

Referring to FIG. 4, a crisper assembly 34 may be disposed in a lower portion 15 of the refrigeration compartment 16. In the illustrated embodiment, the crisper assembly frame 56 is removably coupled to a slider assembly 60A on a bottom portion of the crisper assembly frame 56. The slider assembly 60 is also removably attached to the bottom wall 42 of the refrigeration compartment 16. It is contemplated, however, that the slider assembly 60 may be attached to any portion or surface of the crisper assembly 34 or crisper assembly frame 56. Likewise, the slider assembly 60 may be removably attached to any wall or component within the refrigeration compartment 16.

Figure 6:
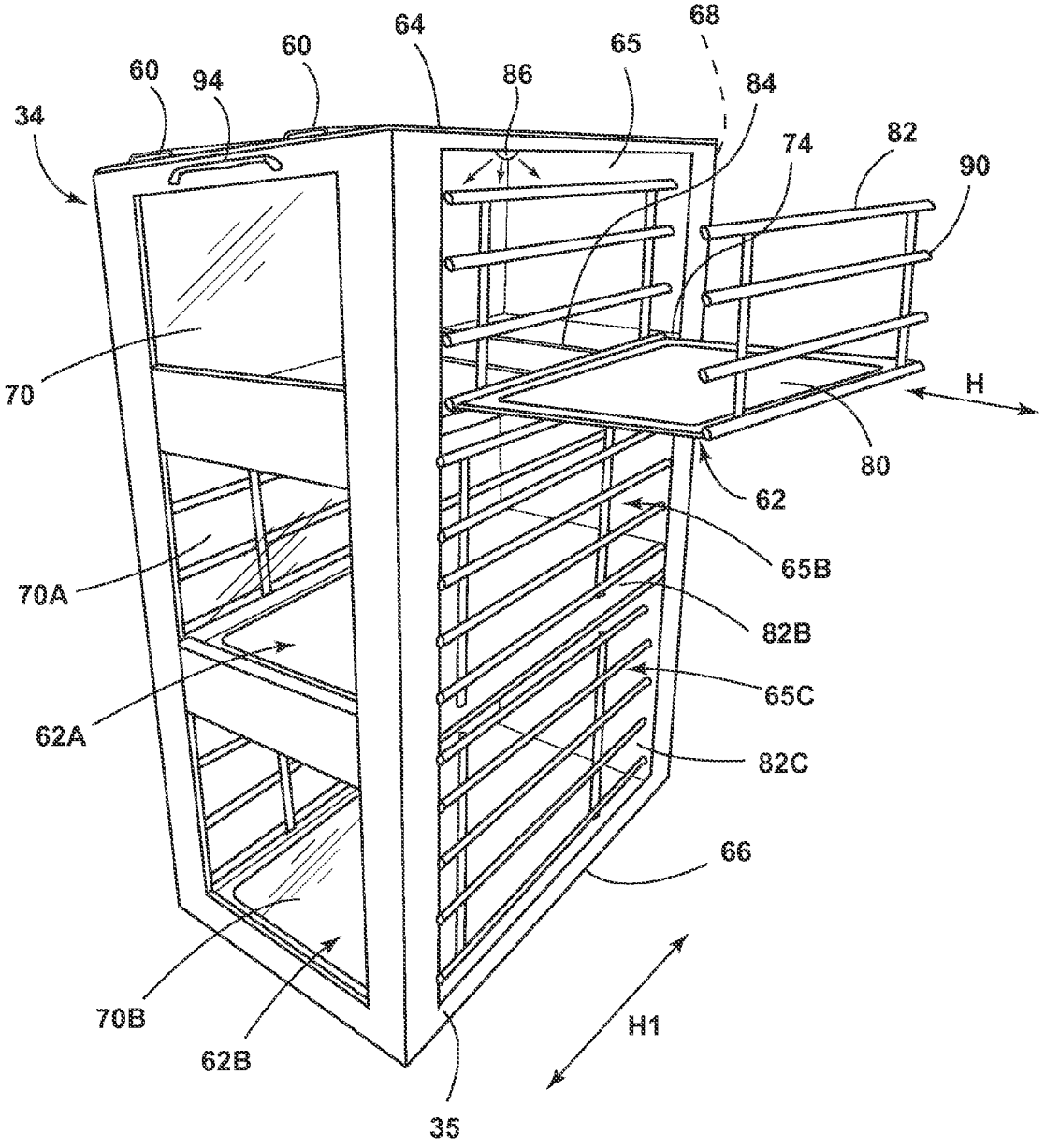
FIG. 6 is a perspective view of the crisper assembly of FIG. 5.
Figure 7:
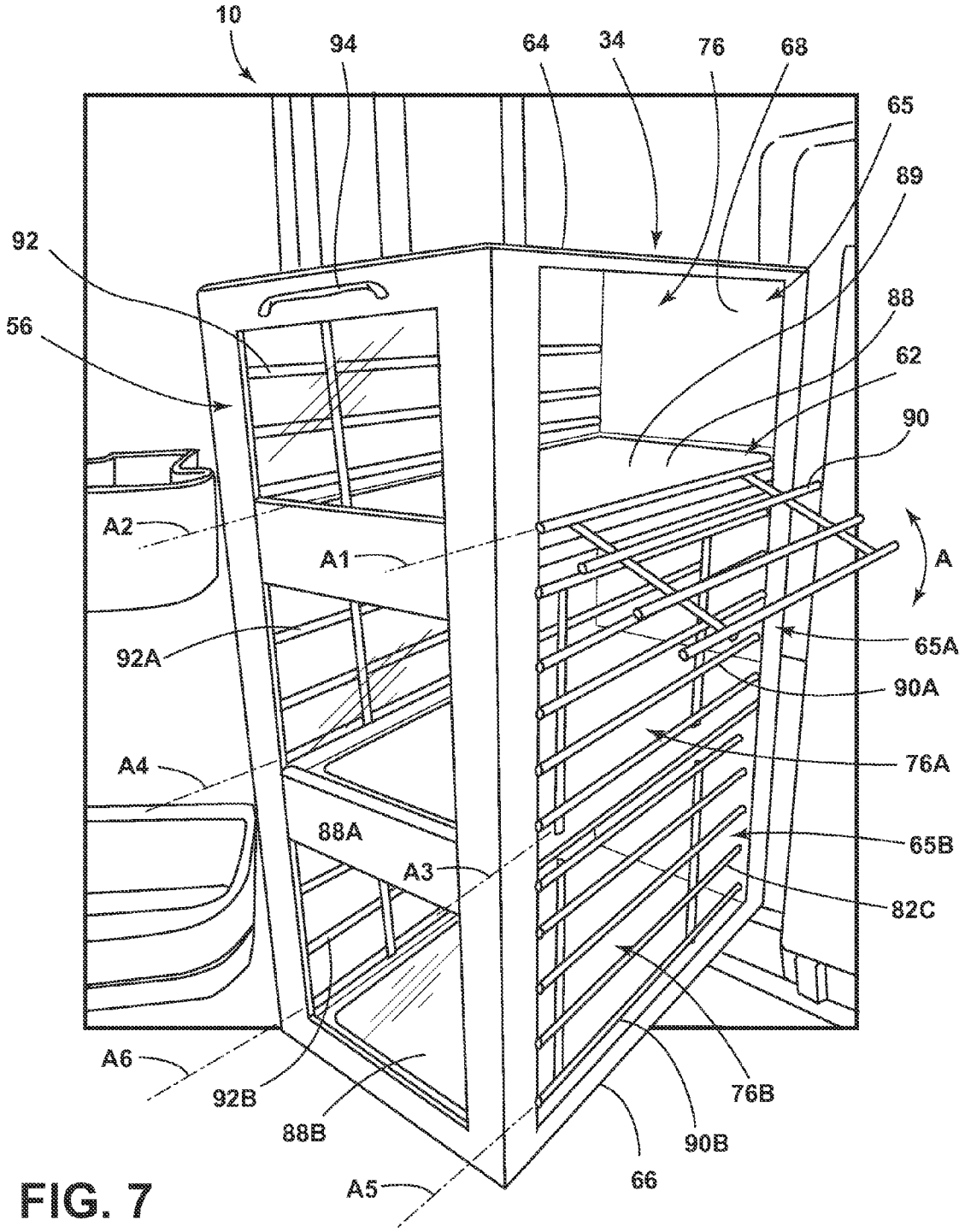
FIG. 7 is a partially fragmentary perspective view of a portion of a refrigerator having a bottom-mount freezer and a crisper assembly according to another aspect of the present invention.

The crisper assembly 34 further includes a bin 62 (FIGS. 5-7) disposed within the crisper assembly 34 that holds food or items disposed within the crisper assembly 34. The bin 62 includes a generally horizontal bottom support tray or member 89 (FIG. 7) and a side member 90 (FIG. 7). In some embodiments, the bin 62 forms a basket and includes first and second sides each of which are pivotably connected to bottom support member 88 or frame 56. Each side of member 90, 90A, 90B, 92, 92A, 92B of the bin 62 may comprise a grate, as illustrated in FIG. 4. It is also contemplated that the side members 90, 92, etc. of the bin 62 may be in the form of any other practical design or shape for holding items within the crisper assembly 34. The bin 62 is preferably made of a polymer material. Exemplary materials from which the side members may be formed include polyethylene terephthalate, polyethylene, polyvinyl chloride, polycarbonate, polypropylene, acrylonitrile butadiene styrene, or any other plastic material known in the art. However, it is contemplated that the side members may be of any practicable material.

Referring again to FIG. 4, the frame 56 of crisper assembly 34 supports a top panel 64, bottom panel 66, rear panel 68, front panel 70, and side panel 72, and horizontal partitions 74A and 74B. The horizontal partitions 74A and 74B are substantially parallel to the top and/or bottom panels 64, 66, respectively, and define three distinct crisper compartments 76, 76A, and 76B within cavity 58 of crisper assembly 34 for storing items therein. The letters "A" and "B" are appended to the corresponding reference characters identifying the components of crisper compartments 76A and 76B. In the illustrated embodiment, the inner side 35 of the crisper assembly 34 is disposed proximate the center of the refrigerator compartment 16.

Inner side 35 includes side openings 65, 65A, 65B that provide access to the crisper compartments 76, 76A, 76B, respectively, of the crisper assembly cavity 58. As discussed in more detail below, bins 62, 62A, 62B, may be movably mounted to frame 56 for horizontal movement from a stowed position to an open position (FIG. 6), through side openings 65, 65A, 65B, and/or the bins 62, 62A, 62Bm respectively (FIG. 7), that move from closed positions to open positions to provide access to bins 62, 62A, 62B though side openings 65, 65A, 65B. Additionally, in alternate embodiments, the crisper assembly 34 may have more or fewer partitions to define 74, more or fewer distinct crisper compartments 76 within the crisper assembly 34. Further, each crisper compartment 76, 76A, 76B, etc. may comprise a separate structural unit, each being independently connected to cabinet 12 by a slider assembly 60 whereby each individual compartment 76, 76A, 76B can be moved between retracted and extended positions independent of the other crisper compartments of the crisper assembly 34.

The crisper assembly 34 may include a handle 94 (see also FIGS. 5-7) that can be grasped to move the crisper assembly 34 between the retracted and extended positions. The handle 94, in the illustrated embodiment, may be attached to the crisper assembly frame 56 or it may be integrally formed with any portion of the crisper assembly 34. The handle 94 may be configured in any form that is suitable for assisting in operating the crisper assembly 34 between a plurality of positions. Each handle 94 and slider assembly 60 may be similar to known drawer handles and sliders or other suitable known design. One or more stops may be utilized to substantially prohibit the crisper assembly 34 from obtaining an outwardly position beyond the a pre-defined extended position.

Referring again to FIG. 4, the bin 62 may optionally include one or more dividers 78 to partition the bin 62. The dividers 78 may be removable to permit a user to form compartments of various sizes, or to permit the entire bin 62 to be undivided. Alternatively, the dividers 78 may be formed integrally with the bin 62 to be permanent. The dividers 78 may comprise small ribs that provide additional structural support to the bin 78.

Figure 5:
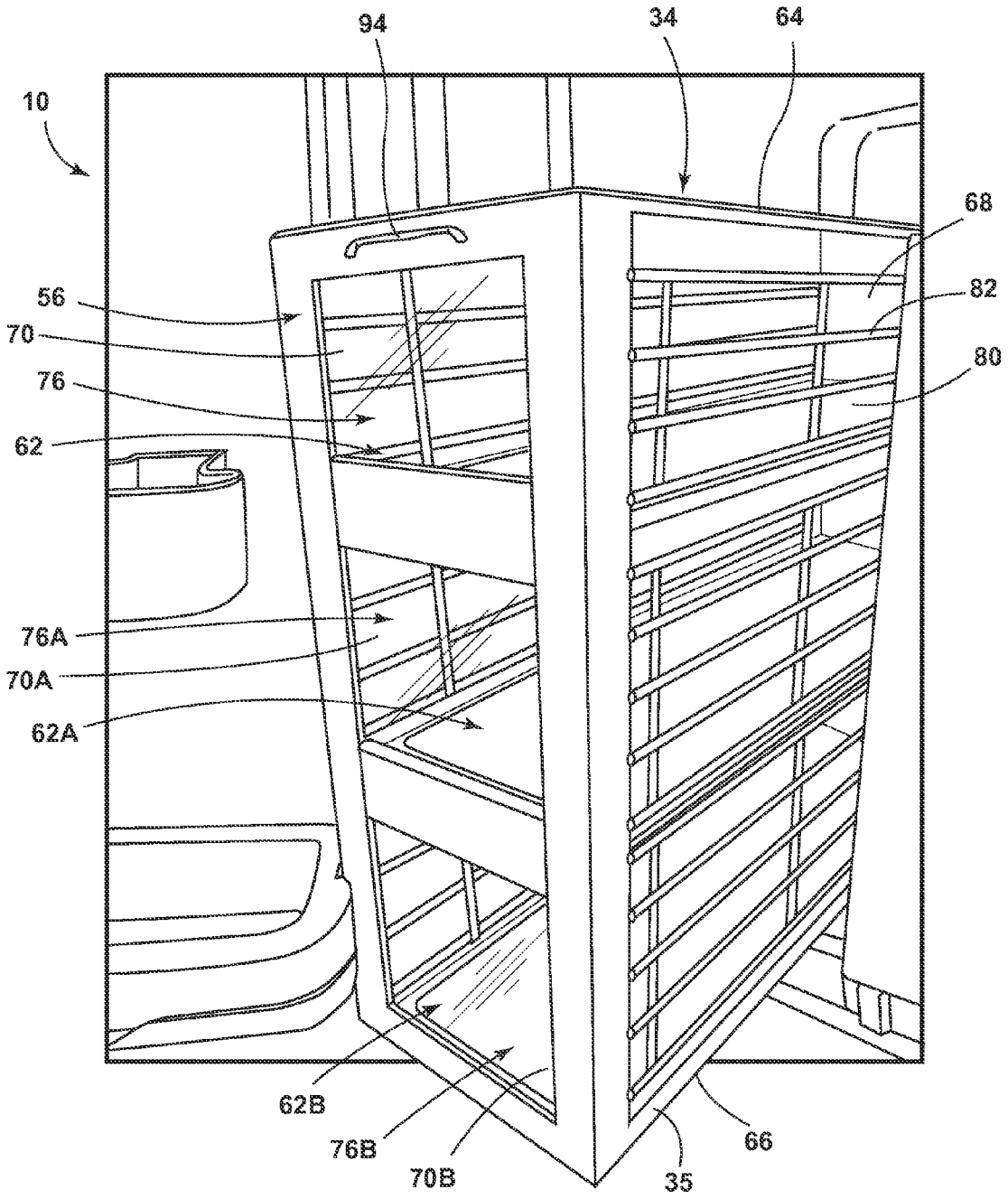
FIG. 5 is a partially fragmentary perspective view of the refrigerator of FIG. 3 and FIG. 4 illustrating a crisper assembly.

Referring again to FIGS. 5 and 6, the crisper assembly 34 is shown in a partially extended position (FIG. 5) and a fully extended position (FIG. 6). In FIG. 5, the bin 62 is in a position such that items stored within the crisper assembly 34 are inaccessible. In FIG. 6, upper bin 62 is shifted outwardly to its fully extended or open position to provide easy access to the contents stored within the bin 62.

Bins 62, 62A, 62B, each include upwardly-facing bottoms surface 80, 80A, and 80B, respectively. Bin 62 includes upwardly-extending side surface members 82 and 83 that retain food or other items on surface 80. Side members 82 and 83 may comprise open gates as shown in FIG. 6, or they may comprise sheets of polymer (not shown) or other suitable material. It is contemplated, however, that the bin 62 may be made of any number of surfaces capable of holding any desired item. The bottom surface 80 of the bin 62 is supported by the bottom panel 66 of the crisper assembly 34, or by a compartment separating portions 74, 74A, 74B of the crisper assembly 34. In alternate embodiments, bin 62 may include a single side surface member 82.

As discussed above, crisper assembly 34 includes a top panel 64, a bottom panel 66, front panels 70, 70A, 70B, and rear panel 68. Thus, when the bin 62 is disposed within the crisper assembly 34, the items stored within the bin 62 may be surrounded on all sides. The bins 62, 62A, 62B are movable between first position wherein the bins 62, 62A, 62B are substantially disposed within the crisper compartment 76 (e.g. lower bins 62A and 62B in FIG. 6) and second position wherein the bin 62 is partially disposed externally from the crisper compartment 76 (e.g. upper bin 62 in FIG. 6). The bin 62 may optionally be removed from the crisper assembly 34 entirely through the open side of the crisper assembly 34.

Referring to FIG. 6, a crisper assembly 34 is movable in a first direction, illustrated by arrow H1 (in/out) between retracted and expanded positions. Bins 62, 62A, and 62B are movable in a second direction H that is transverse to the direction H1. The second direction H, in the illustrated embodiment, is substantially perpendicular to the directional movement of the crisper assembly 34 along the slider assembly 60 between the retracted and extended positions. Bin 62 may be movably connected to frame 56 for movement in the direction of arrow H or by linear slide assembly 84 or other suitable arrangement. In alternate embodiments, the first and second directions may be parallel, or any practicable relationship making items disposed within the bin 62 non-accessible in a first position and accessible in a second position.

The crisper assembly 34 may additionally be configured to include a light source 86 that may be activated to illuminate the contents of the bin 62. The light source 86 may be configured as various light types, such as, but not limited to, halogen lights, fluorescent lights, light emitting diodes (LEDs), organic LEDs (OLEDs), and polymer LEDs (PLEDs). For example, an ultraviolet LED 86 may be disposed such that the UV LED 86 may emit UV light in crisper assembly 34. The UV LED 86 is connected to a power source and may be connected to control circuitry (not shown) as is known in the art. The UV LED 86 may be any suitable device that emits radiation at a wavelength that is able to disinfect any items stored in the bin 62. The LED 86 may be controlled based on a wide range of pre-defined events, such as when the refrigerator door 18 is opened, when the crisper assembly 34 is placed in the extended position, or when the bin 62 is moved from the first position to the second position or when any other pre-defined event occurs.

Referring to FIG. 7, an alternate embodiment is shown, wherein the bin 62 of the crisper assembly 34 includes a side door 88 that is rotatably interconnected to frame 56 or to bin 62. When the side door 88 is in a first (closed) position, the items stored within the bin 62 are inaccessible. When the side door 88 is rotated to a second (open) position, the items stored within the bin 62 are accessible through opening 65. The side door 88 of the bin 62 may include a hinge or may be rotatably fixed to another portion of the bin 62.

The remaining portions of the bin 62, including the base portion 90, may be stationary, or may move to a position external the crisper assembly 34 making items within the bin 62 more accessible. The bin 62 may also be configured to stop outward movement from within the crisper assembly 34 at a desired point through the use of a stop assembly. The stop assembly may be an additional component. In alternate embodiments, the second side portion 92 is longer than the void on the opposing side of the crisper assembly frame 56 such that the overlap creates a stoppage point for the bin 62.

It will be understood that the arrangements of FIGS. 6 and 7 are not mutually exclusive alternatives. Thus, the horizontally movable bins 62, 62A, 62B of FIG. 6 may include movable doors 90, 90A, 90B as shown in FIG. 7 whereby a user can access bins 62, 62A, 62B by horizontally sliding the bins (FIG. 6) and by opening the doors (FIG. 7).

Accordingly a crisper assembly for a refrigerator operable between a retracted and extended position that is further configured to include a movable bin within the crisper assembly providing better access to items disposed therein has been advantageously described herein.

For the purposes of describing and defining the present teachings, it is noted that the terms "substantially" and "approximately" are utilized herein to represent the inherent degree of uncertainty that may be attributed to any quantitative comparison, value, measurement, or other representation. The term "substantially" and "approximately" are also utilized herein to represent the degree by which a quantitative representation may vary from a stated reference without resulting in a change in the basic function of the subject matter at issue.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. A crisper assembly for a refrigerator, the assembly comprising:

a crisper structure defining a crisper cavity within the crisper structure;

a guide configured to movably attach the crisper structure to a refrigerator and movably support the crisper structure for movement in a first direction between a retracted position within a refrigerator compartment and an extended position; and a bin movably supported by the crisper structure for movement in a second direction between a first position wherein the bin is disposed in the crisper cavity and second position wherein at least a portion of the bin is disposed outside the crisper cavity, wherein an interior of the crisper assembly is visible when the bin is in both the first position and the second position.

2. The crisper assembly of claim 1, wherein the second direction is perpendicular to the first direction.

3. The crisper assembly of claim 1, further comprising a linear slide assembly disposed between the crisper assembly and bin configured to move the bin between the first and second positions.

4. The crisper assembly of claim 1, wherein the guide comprises a linear guide configured to provide linear movement of the crisper structure relative to a refrigerator cabinet.

5. The crisper assembly of claim 1, wherein crisper assembly includes a plurality of bins that are vertically juxtaposed relative to one another, and wherein each bin is movable in a second direction that is transverse to the first direction.

6. The crisper assembly of claim 1, wherein the bin includes a door that is movably mounted to the bin for movement between opened and closed positions.

7. A refrigerator comprising:

an insulated cabinet defining a refrigerated compartment;

a door movably mounted to the insulated cabinet and providing access to the refrigerated compartment;

a crisper assembly disposed within the compartment configured to maintain uniform humidity defined by a plurality of surfaces wherein the crisper assembly is movably supported by the insulated cabinet for generally horizontal movement from a retracted position within the refrigerated compartment to an extended position wherein a portion of the crisper assembly is disposed outside the refrigerated compartment; and a bin movably supported by the crisper assembly, the bin movable between a first position and a second position, wherein the bin includes a rotatable side portion that allows access to the bin when the bin is in the first and the second position.

8. The refrigerator of claim 7, wherein the door provides access to the refrigeration compartment and a second door provides access to the crisper assembly and the first and second doors each seal a respective portion of a refrigerated compartment.

9. The refrigerator of claim 7, wherein the crisper assembly further comprises a divider configured to partition the bin.

10. The refrigerator of claim 7, wherein a front surface of the crisper assembly is substantially transparent.

11. The refrigerator of claim 7, wherein the crisper assembly is configured to provide specific temperature control therein.

12. The refrigerator of claim 7, wherein the bin is configured as a basket having two side surfaces and a bottom surface for storing items therein.

13. The refrigerator of claim 7, wherein the bin includes a side portion rotatable between a first position and a second position for providing access to items stored within the crisper assembly.

14. The refrigerator of claim 7, wherein a slide assembly is removably coupled to a bottom surface of the crisper assembly and a corresponding bottom surface of the refrigerator compartment.

15. A crisper for a refrigerator comprising:

a frame supporting a plurality of surfaces, wherein the frame is movable relative to said refrigerator in a first direction; and a bin configured to be substantially disposed within the frame and to hold refrigerated items therein, wherein a portion the bin is independently movable in a second direction between a first position and a second position, wherein the bin includes a bottom surface, opposing upwardly extending side surfaces, an open front portion, and an open rear portion such that items within the bin are visible in the first and second positions.

16. The crisper of claim 15, wherein the two opposing bin side surfaces are configured as grates.

17. The crisper of claim 15, wherein the plurality of surfaces supported by the frame include a top, bottom, rear, and front surfaces.

18. The crisper of claim 15, further comprising a light source.

19. The crisper of claim 18, wherein the light source is configured as a UV LED that emits radiation to disinfect any items stored in the bin.

20. The crisper of claim 15, wherein at least one of the two opposing bin side surfaces is rotatable about an axis that is substantially parallel with the base surface of the bin.

* * * * *